US007705225B2

(12) United States Patent
Caldwell et al.

(10) Patent No.: US 7,705,225 B2
(45) Date of Patent: Apr. 27, 2010

(54) LOCKING NUT FOR GUITAR

(76) Inventors: Marcus Caldwell, 963 Elkton Dr., Colorado Springs, CO (US) 80997; Jeff Lathrop, 6579 Connie Lee Ct., Falcon, CO (US) 80831

( * ) Notice: Subject to any disclaimer, the term of this patent is extended or adjusted under 35 U.S.C. 154(b) by 0 days.

(21) Appl. No.: 11/780,899

(22) Filed: Jul. 20, 2007

(65) Prior Publication Data

US 2008/0011147 A1 Jan. 17, 2008

Related U.S. Application Data

(62) Division of application No. 11/426,335, filed on Jun. 26, 2006, now Pat. No. 7,297,851.

(60) Provisional application No. 60/595,377, filed on Jun. 28, 2005.

(51) Int. Cl.
*G10D 3/06* (2006.01)
*G10D 3/14* (2006.01)

(52) U.S. Cl. ..... 84/298; 84/297 R; 84/314 N; 84/312 R

(58) Field of Classification Search ..... 84/7–9, 84/173, 267–270, 293, 294, 297 R, 303–306, 84/312 R, 314 R, 314 N, 298
See application file for complete search history.

(56) References Cited

U.S. PATENT DOCUMENTS 2,201,869 A * 5/1940 Nickel, Jr. ..... 84/297 R
3,000,253 A * 9/1961 Houde ..... 84/312 R
3,056,329 A 10/1962 Butts
3,424,049 A 1/1969 Daniel
3,599,524 A * 8/1971 Jones ..... 84/412
4,295,404 A 10/1981 Smith
4,475,432 A * 10/1984 Stroh ..... 84/314 N
4,497,236 A 2/1985 Rose
D278,067 S 3/1985 Bowen
4,574,678 A * 3/1986 Edwards ..... 84/314 N
4,579,033 A * 4/1986 Edwards ..... 84/314 N
4,669,350 A * 6/1987 Gressett et al. ..... 84/314 N
4,742,750 A 5/1988 Storey
4,768,415 A 9/1988 Gressett, Jr. et al.
4,779,506 A 10/1988 Takeuti
4,811,646 A 3/1989 Hoshino
4,860,628 A * 8/1989 Storey ..... 84/313
4,945,801 A * 8/1990 Stroh et al. ..... 84/314 N
4,967,631 A 11/1990 Rose
5,088,374 A 2/1992 Saijo
5,196,641 A 3/1993 Schaller
5,373,769 A * 12/1994 Sherman ..... 84/313
5,394,783 A * 3/1995 Sperzel ..... 84/297 R
5,413,019 A 5/1995 Blanda, Jr.
5,419,227 A 5/1995 Lavineway
5,429,028 A 7/1995 Fisher, IV
5,438,901 A * 8/1995 Sperzel ..... 84/297 R (Continued)

*Primary Examiner*—Jeffrey Donels
*Assistant Examiner*—Christopher Uhlir

(57) ABSTRACT

A bridge assembly for a guitar having a bridge plate connected to an anchor plate by a single, horizontally positioned flat spring. The bridge plate has an opening that receives a portion of a sustain block. The sustain block has receptacles for receiving fine tuners and string clamps. Intonation screws extend through flange openings on the bridge plate and are adjustably connected to saddles. A locking nut is positioned on the neck of the guitar having a plurality of pieces connected by a tensioning bolt. At least one piece has one or more stabilizing flanges.

9 Claims, 8 Drawing Sheets

U.S. PATENT DOCUMENTS 5,492,044 A * 2/1996 Sperzel ..... 84/297 R
5,522,297 A 6/1996 Enserink
5,589,653 A * 12/1996 Rose ..... 84/314 N
5,672,835 A 9/1997 Doughty
5,708,225 A 1/1998 Sherman
6,046,393 A 4/2000 Rose
6,198,030 B1 3/2001 Rose
6,198,036 B1 3/2001 Hoshino
6,300,550 B1 10/2001 Smith
6,700,043 B2 * 3/2004 Hirayama ..... 84/314 N
6,867,354 B2 3/2005 Shimooka et al.
2004/0159204 A1 * 8/2004 Rose ..... 84/298

* cited by examiner

LOCKING NUT FOR GUITAR

CROSS REFERENCE TO RELATED APPLICATION

This application is a divisional of application Ser. No. 11/426,335 filed Jun. 26, 2006, which gained its antecedent basis from provisional patent application Ser. No. 60/595,377 filed Jun. 28, 2005.

BACKGROUND OF THE INVENTION

The present invention is directed to guitar bridges and more particularly to vibrato style guitar bridges.

The Fender Stratocaster was introduced in the early 1950s and it has since become one of the most popular electric guitars of all time. The vibrato bridges (sometimes referred to as tremolo) found on the Stratocaster and other similar guitars are all affected by a similar problem; the strings go out of tune (i.e. sharp) when the vibrato arm is depressed and then released.

Several products currently on the market are designed to correct the inherent design flaws of tremolo style bridges. The two most popular models are the Floyd Rose and Wilkinson vibratos. The Wilkinson vibrato offers improved quality construction as compared with the original Stratocaster hardware, but does not solve the inherent tuning problem. The Floyd Rose vibrato design does address the tuning problem; however, other difficulties remain. Specifically, the Floyd Rose vibrato design is complicated, has a non-traditional look, and does not fit well with vintage guitars. Additionally, both the Floyd Rose and Wilkinson vibratos require extensive and irreversible modification of the guitar body and neck.

Locking nuts are also known in the art to assist in maintaining the tuning of the strings. Known locking nuts, however, require that the head stock be modified. Accordingly, there exists a need in the art for a bridge and locking nut that address the problems in the art.

SUMMARY OF THE INVENTION

A bridge assembly for a guitar having a bridge plate connected to an anchor plate by a flat spring. A single flat spring is positioned parallel to the guitar body to allow for movement between the anchor plate and the bridge plate yet support the tension of the strings without bending. The bridge plate has an opening that receives a portion of a sustain block. The block bridge plate provides for secure mounting of the sustain block via mounting screws. The sustain block has receptacles for receiving fine tuners and string clamps. Intonation screws extend through flange openings on the bridge plate and are adjustably connected to saddles. A locking nut is positioned on the neck of the guitar having a plurality of pieces connected by a tensioning bolt. At least one piece has one or more stabilizing flanges.

DETAILED DESCRIPTION OF THE PREFERRED EMBODIMENT

Figure 1:
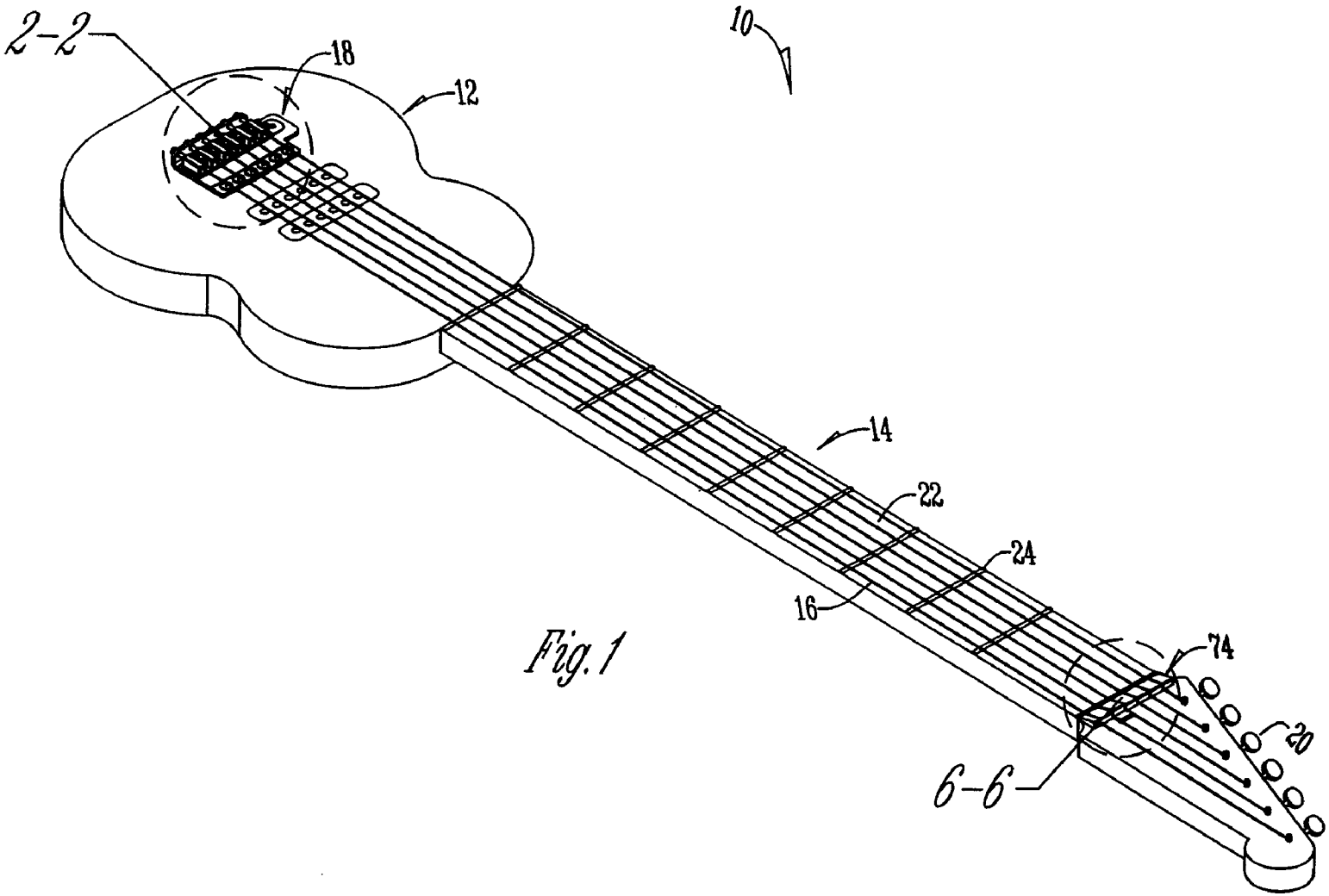
FIG. 1 is a perspective view of a guitar with a bridge apparatus.
Figure 2:
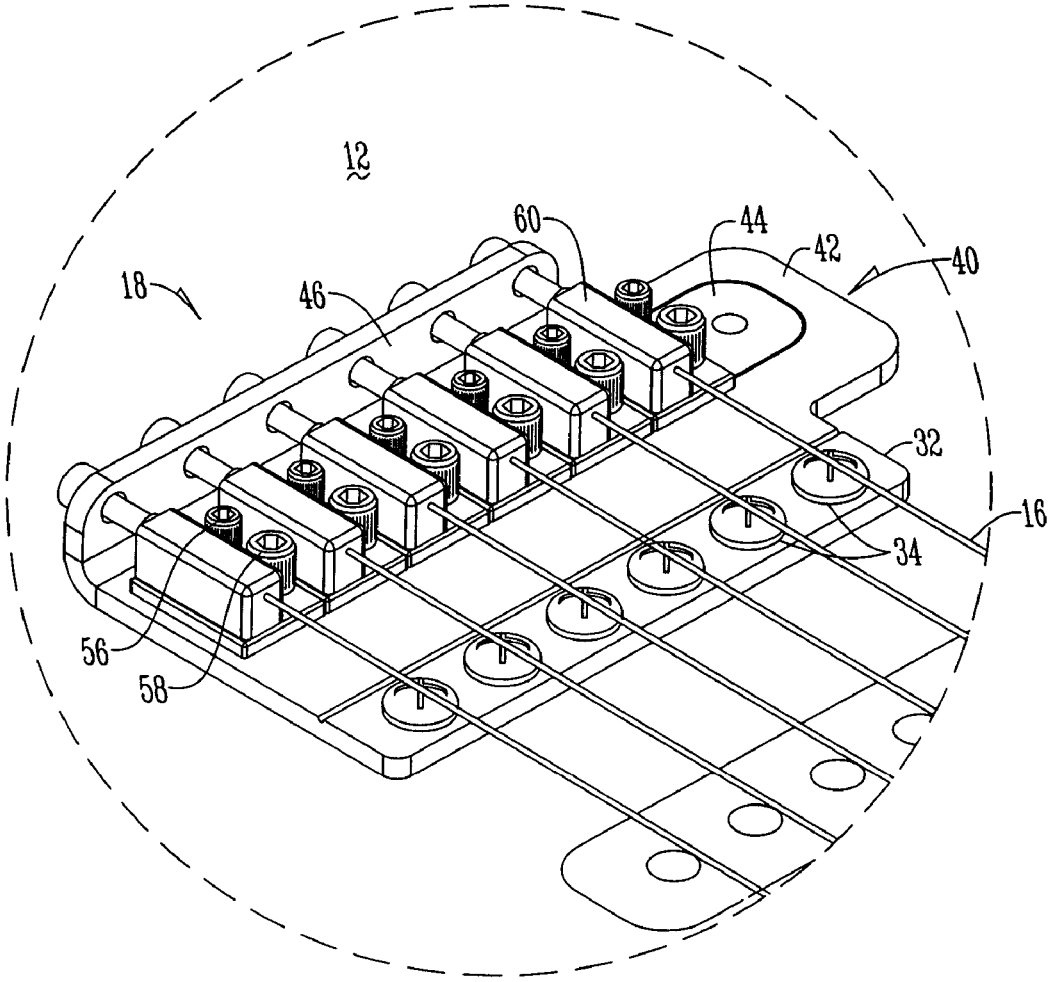
FIG. 2 is a plan view of a bridge apparatus.
Figure 3:
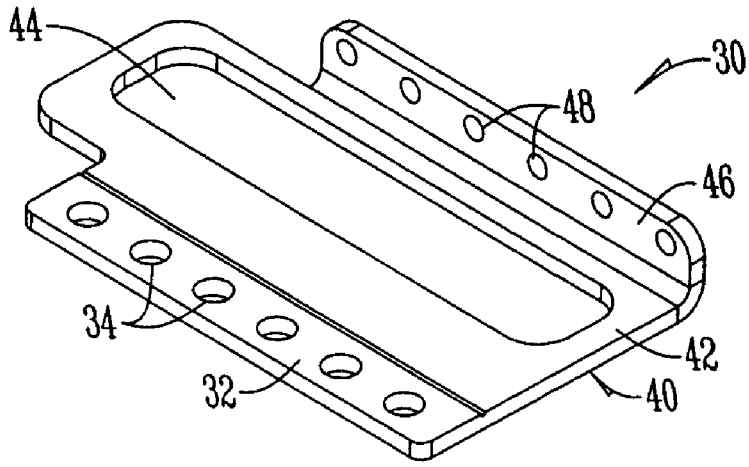
FIG. 3 is a perspective view of an anchor plate connected to a bridge plate.
Figure 4:
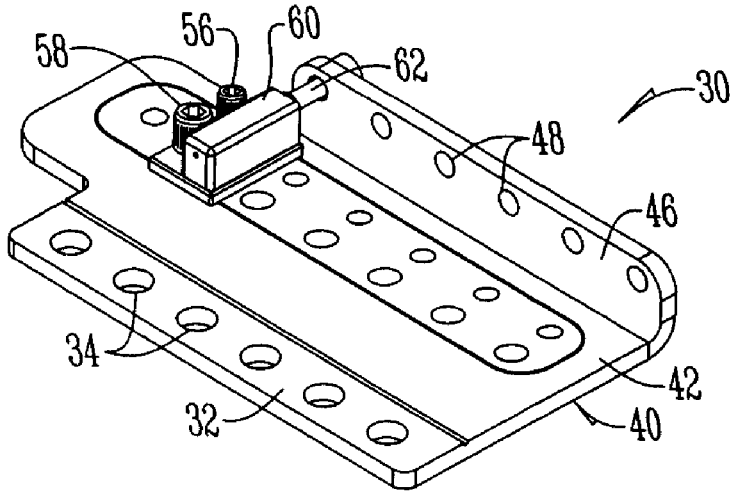
FIG. 4 is a perspective view of an anchor plate connected to a bridge plate.
Figure 5:
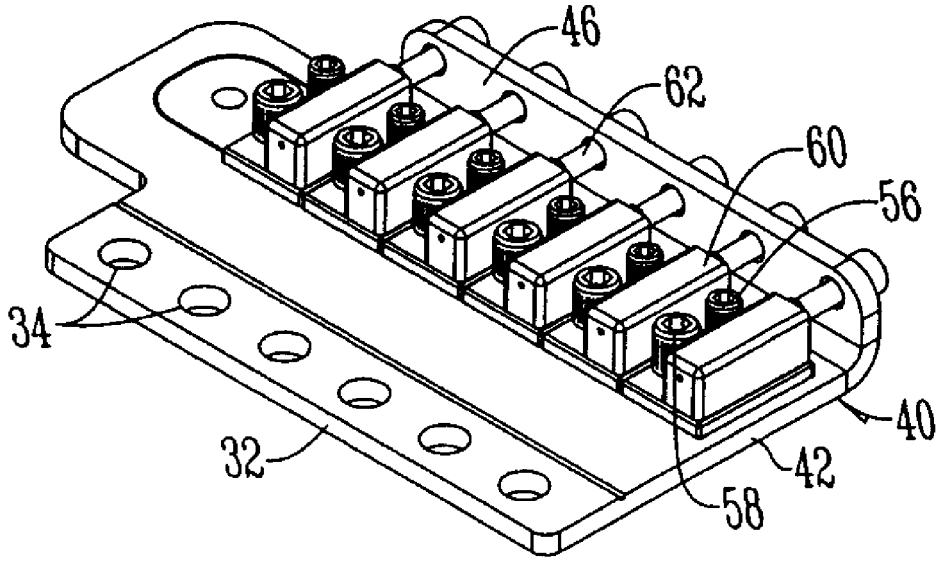
FIG. 5 is a perspective view of a bridge assembly.
Figure 6:
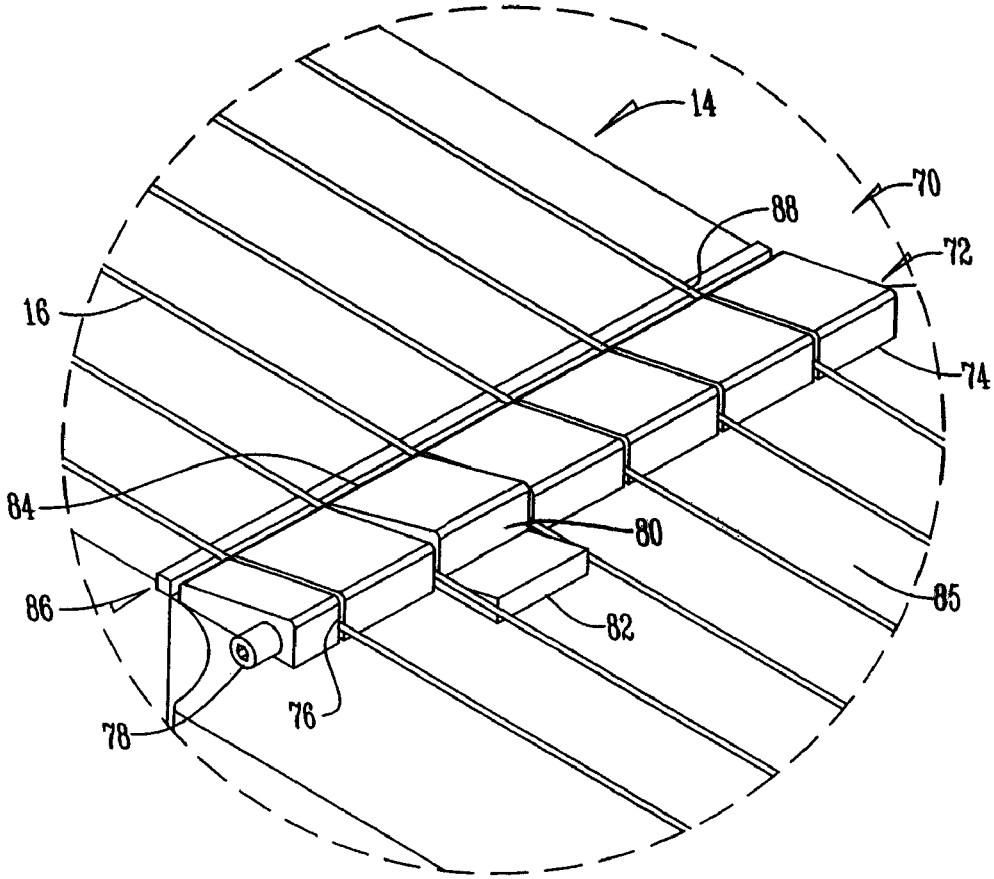
FIG. 6 is a plan view of a locking nut.

Referring to the figures, a guitar 10 includes a guitar body 12 having a neck 14 extending therefrom. Strings 16 extend from a bridge 18 to tuning pegs 20 along the guitar 10. The strings 16 are positioned over a finger board 22 on the neck 14, where the finger board 22 includes frets 24 extending therefrom.

A bridge assembly 30 includes an anchor plate 32 having through holes 34 formed therein. Screws 36 are received within through holes 34 and rigidly secure the anchor plate 32 to the guitar body 12.

A flat spring or springs 38 are flexibly secured between the anchor plate 32 and a bridge plate 40. The flat spring 38 may preferably be formed of spring tempered steel, or any other suitable material. The flat spring 38 is adapted to repeatedly bend without permanent deformation and applies bias force on the bridge plate 40 with respect to the anchor plate 32. The flat spring 38 also serves to accurately locate the bridge assembly with regard to the guitar body 12 so the bridge plate returns to its exact starting position. The flat spring additionally serves as a very rigid yet completely frictionless pivot point. Due the geometry of the bridge design, only one flat spring is required positioned horizontally and parallel to the guitar body.

The bridge plate 40 includes a main body 42 having a rectangular block opening 44 located therein. A vertical flange 46 extends perpendicularly from the main body 42 and includes openings 48 located therein.

A sustain block 50 is located beneath the main body 42. At least a portion of the sustain block 50 is located within the block opening 44 of the bridge plate 40 and is (permanently welded) rigidly attached in place. The sustain block 50 includes a plurality of fine tuner receptacles 52 and a plurality of string clamp receptacles 54 formed as apertures or slots in the portion of sustained block 50 located within the block opening 44 of bridge plate 40. The fine tuner receptacle 52 receives at least a portion of a fine tuner 56 when a fine tuner 56 is secured to the sustain block 50. Similarly, string clamp receptacle 54 receives at least a portion of a string clamp 58 when the string clamp 58 is secured to the sustained block 50.

A plurality of height adjustable saddles 60 are positioned above the bridge plate 40 opposite the sustain block 50. Each saddle is individually adjustable to compensate for various fret board radii. The saddle adjusts screws 62 are adapted to adjust the height of the saddles 60 with respect to the bridge plate 40. A plurality of intonation adjust screws 62 extend through the openings 48 of the vertical flange 46 to adjustably connect to saddles 60.

A locking nut 70 is positioned on the neck 14 beneath strings 16. Locking nut 70 includes a main nut body 72 preferably formed of a single piece with machined slots 71 or a plurality of nut pieces 74 placed adjacent to one another with openings 76 formed therebetween. A tensioning bolt or bolts 78 connect the nut pieces 74 together. The tensioning nut 78 clamps the strings 16 located within the openings 76.

One or more of the nut pieces 74 is formed as a stabilizing piece 80 with flanges 82, 84 extending therefrom. As shown the stabilizing piece 80 is a single centrally located flange. Alternatively, depending on the headstock shape, the stabilizing piece 80 is configured with two or more stabilizing flanges. Flange 82 of the stabilizing piece 80 extends from the main nut body 72 towards the tuning peg 20 end of guitar 10 and engages the head stock 85. Flange 84 of the stabilizing piece 80 extends opposite flange 82 towards the guitar body 12 and engages nut 86. The nut 86 includes string grooves 88 for receiving strings 16 therein.

In operation, the bridge assembly 30 and locking nut 70 operate keep guitar 10 in tune when the vibrato is used. The bridge assembly 30 and locking nut 70 fit all Fender Stratocasters and Stratocaster copies made throughout the world. No modifications to the neck 14 or guitar body 12 are required for installing either the bridge assembly 30 or the locking nut 70. The bridge assembly 30 and the locking nut 70 maintain a traditional/classic look and playability to the guitar 10 when installed. The flat spring 38 feature of the bridge assembly 30 provides an improved pivot design that eliminates wear and friction on the bridge assembly 30. The strings are clamped in place with the tensioning bolt 78. The tensioning bolt can be repeatably loosened and re-tightened for string changes. The locking nut maintains a stable position in the transverse and longitudinal directions due to the centrally located stabilizing piece and the downward force of the strings on the nut.

The bridge assembly 30 and locking nut 70 of the present invention addresses the inherent problem of "de-tuning" of the strings during vibrato use. The present invention fits the vintage "look and feel", and is of simple design with relatively few parts. Additionally, the present invention installs without requiring modification to the neck 14 or guitar body 12 of a guitar 10.

Figure 7:
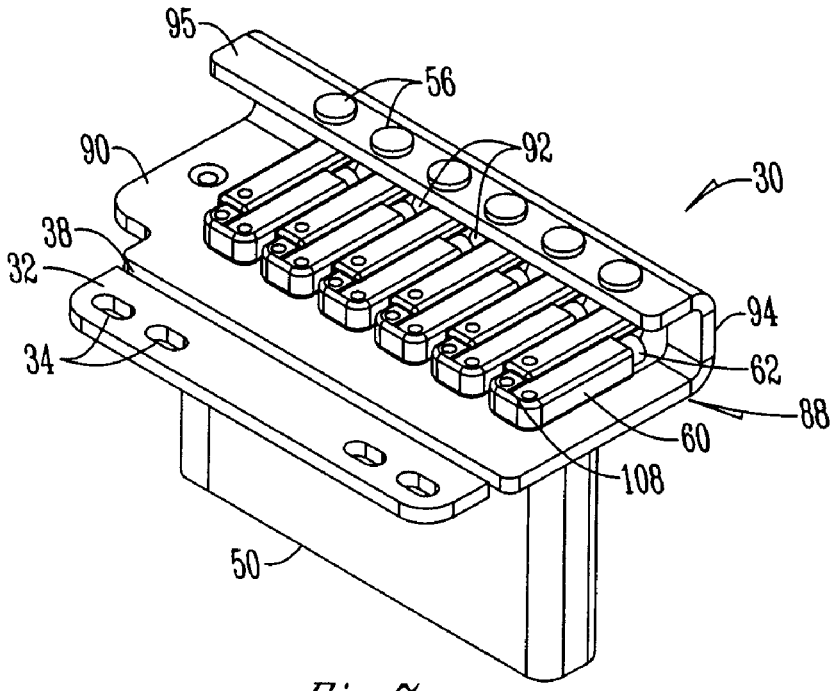
FIG. 7 is a perspective view of a bridge assembly.
Figure 8:
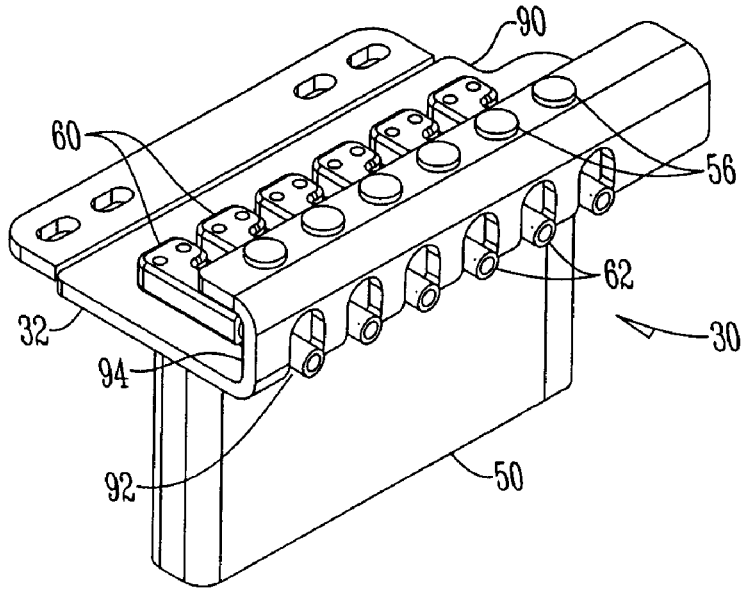
FIG. 8 is a perspective view of a bridge assembly.
Figure 9:
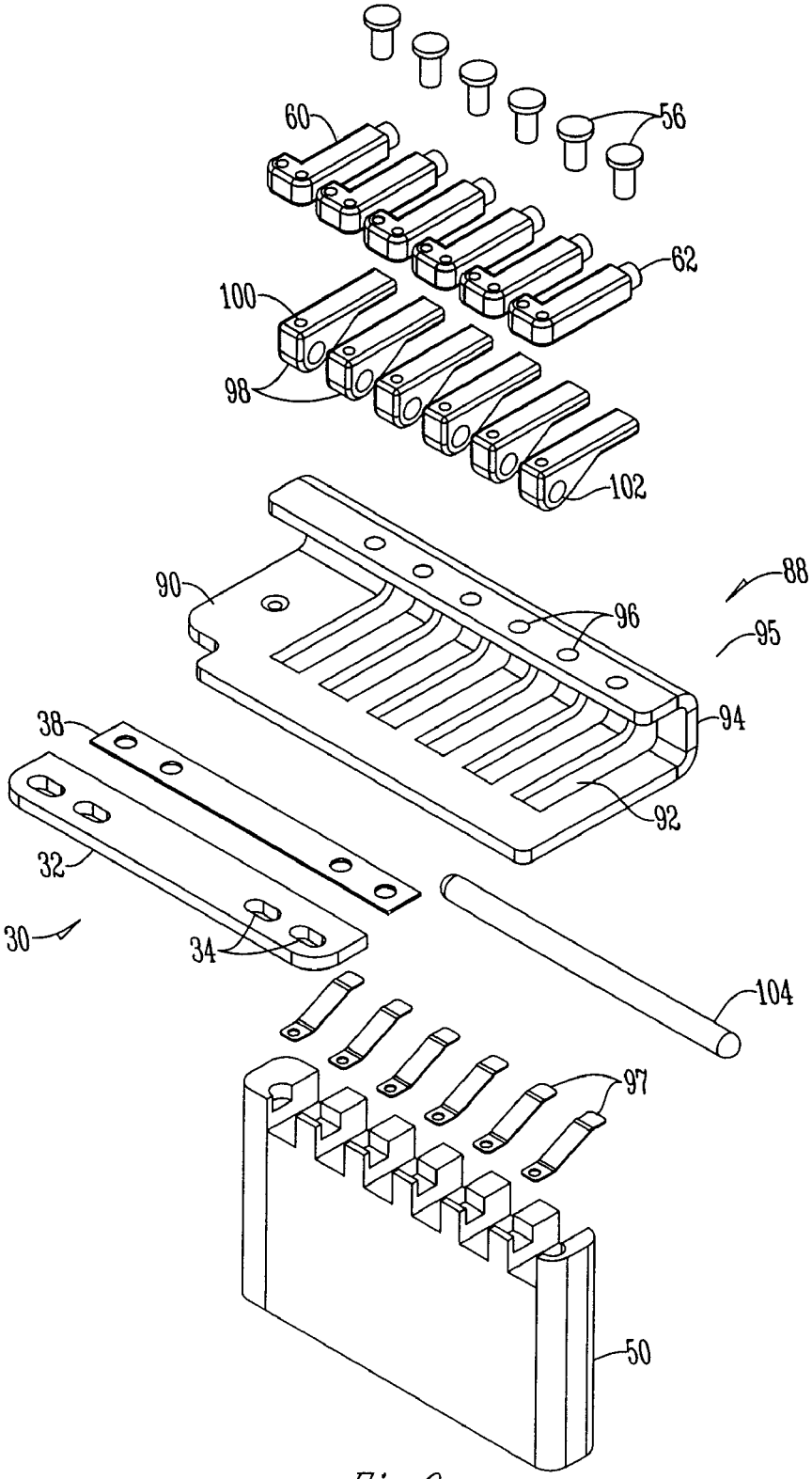
FIG. 9 is an exploded view of a bridge assembly.
Figure 10:
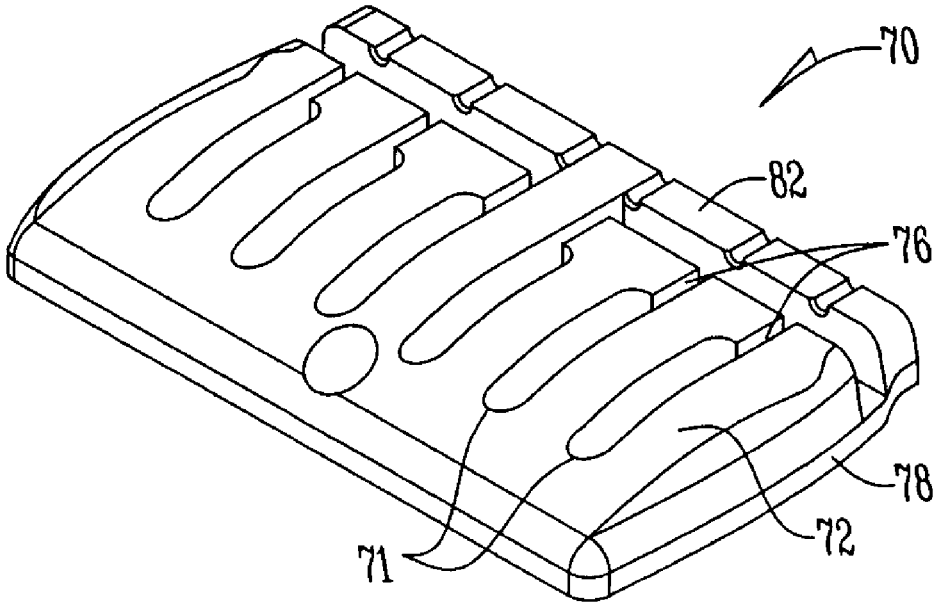
FIG. 10 is a perspective view of a locking nut.

In an alternative embodiment, as shown in FIGS. 7, 8, and 9 the bridge assembly 30 includes an anchor plate 32 having through holes 34 formed therein. Screws 36 are received within through holes 34 and rigidly secure the anchor plate 32 to the guitar body 12. A flat spring or springs 38 are flexibly secured between the anchor plate 32 and a bridge plate 88. The flat spring 38 may preferably be formed of spring tempered steel or any other suitable material. The flat spring 38 is adapted to repeatedly bend without permanent deformation and applies bias force on the bridge plate 88 with respect to the anchor plate 32. The flat spring 38 also serves to accurately locate the bridge assembly 30 with regard to the guitar body 12 so the bridge plate returns to its exact starting position. The flat spring additionally serves as a very rigid yet completely frictionless pivot point. The flat spring is positioned parallel to the guitar body in its resting state providing rigid support for the string tension and still allow movement between the anchor plate and bridge assembly.

The bridge plate 88 includes a main body 90 having a plurality of grooves 92. A vertical flange 94 extends perpendicularly from the main body 90 and terminates in a horizontal shelf 95. The shelf 94 has a plurality of apertures 96 that receive a plurality of fine tuners 56.

A sustain block 50 is located beneath the main body 90 and at least a portion of the sustain block 50 extends through grooves 92 connected to the sustain block are a plurality of return springs 97 and a plurality of rocker arms 98. The rocker arms 98 are generally L-shaped with a vertical bore 100 for receiving a string 16 and a horizontal bore 102 for receiving a rod 104. The rod 104 extends through bores 102 such that the rockers 98 pivot about the rod 104 and are biased by the return springs 97. The rod is secured in a longitudinal groove located in the sustain block and captured by the bridge plate above.

A plurality of height adjustable saddles 60 are connected to the intonation screws protruding through the vertical flange of the bridge plate and biased by individual springs (rocker arms 98). Each saddle 60 is individually adjustable to compensate for various fret board radii. The saddle adjacent screws 62 are adapted to adjust the height of the saddles 60. The string 16 that is received within vertical bore 100 of the rocker arm 98 extends over the end 106 of the rocker arm 98 and through slot 108 formed within saddle 60.

It is therefore seen that the bridge assembly and locking nut of the present invention will accomplish at least all of its stated objectives.

What is claimed:

1. A locking nut for use with a guitar, having a headstock and tuning pegs comprising:

a main nut body having a plurality of nut pieces connected together with a tensioning bolt; and at least one piece having at least one flange extending outwardly from the piece toward the tuning pegs and engaging the headstock.

2. The nut of claim 1 wherein at least one of the flanges engages a nut having an opening adapted to receive strings.

3. The nut of claim 1 wherein at least one of the flanges engages a head stock.

4. The nut of claim 1 wherein at least one of the flanges engages a nut.

5. A locking nut for use with a guitar, comprising:

a main body formed of a single piece having a plurality of machined slots and a tensioning bolt that extends transversely through the main body, and engaging a plurality of nut pieces to clamp strings; and at least one flange extending outwardly from the main body toward a plurality of tuning pegs.

6. The nut of claim 5 wherein at least one of the flanges engages a head stock.

7. The nut of claim 5 wherein a plurality of nut pieces are placed adjacent one another with openings therebetween.

8. The nut of claim 5 wherein an opening is connected to the machined slots.

9. The nut of claim 5 wherein the tensioning bolt extends through the main body to clamp strings located within the machined slots.

* * * * *